US005389234A

United States Patent [19]

Bhargava et al.

[11] Patent Number: 5,389,234

[45] Date of Patent: Feb. 14, 1995

[54] WASTE SLUDGE DISPOSAL PROCESS

[75] Inventors: Alok K. Bhargava, Whipanny, N.J.; Wai Seung W. Louie, Brooklyn, N.Y.; Arthur N. Stefani, Princeton, N.J.

[73] Assignee: ABB Lummus Crest Inc., Bloomfield, N.J.

[21] Appl. No.: 91,875

[22] Filed: Jul. 14, 1993

[51] Int. Cl.[6] ..... C10G 9/14

[52] U.S. Cl. ..... 208/131; 208/50

[58] Field of Search ..... 208/131, 50

[56] References Cited

U.S. PATENT DOCUMENTS 3,917,564 11/1975 Meyers ..... 208/131
4,014,661 3/1977 Hess et al. ..... 208/131
4,666,585 5/1987 Figgins et al. ..... 208/131
4,839,021 6/1989 Roy ..... 208/131
4,874,505 10/1989 Bartilucci et al. ..... 208/131
4,968,407 11/1990 McGrath et al. ..... 208/131
5,041,207 8/1991 Harrington et al. ..... 208/131
5,068,024 11/1991 Moretta et al. ..... 208/131
5,110,449 5/1992 Venardos et al. ..... 208/131
5,114,564 5/1992 Goyal ..... 208/131

*Primary Examiner*—Helane Myers
*Attorney, Agent, or Firm*—Clinton, Alix & Van Kirk

[57] ABSTRACT

Waste refinery sludge having a high water content along with hydrocarbon liquids and solids is disposed of in a delayed coking process. The sludge is pretreated and heated to a coking temperature and then introduced into the top of a delayed coking drum.

1 Claim, 1 Drawing Sheet

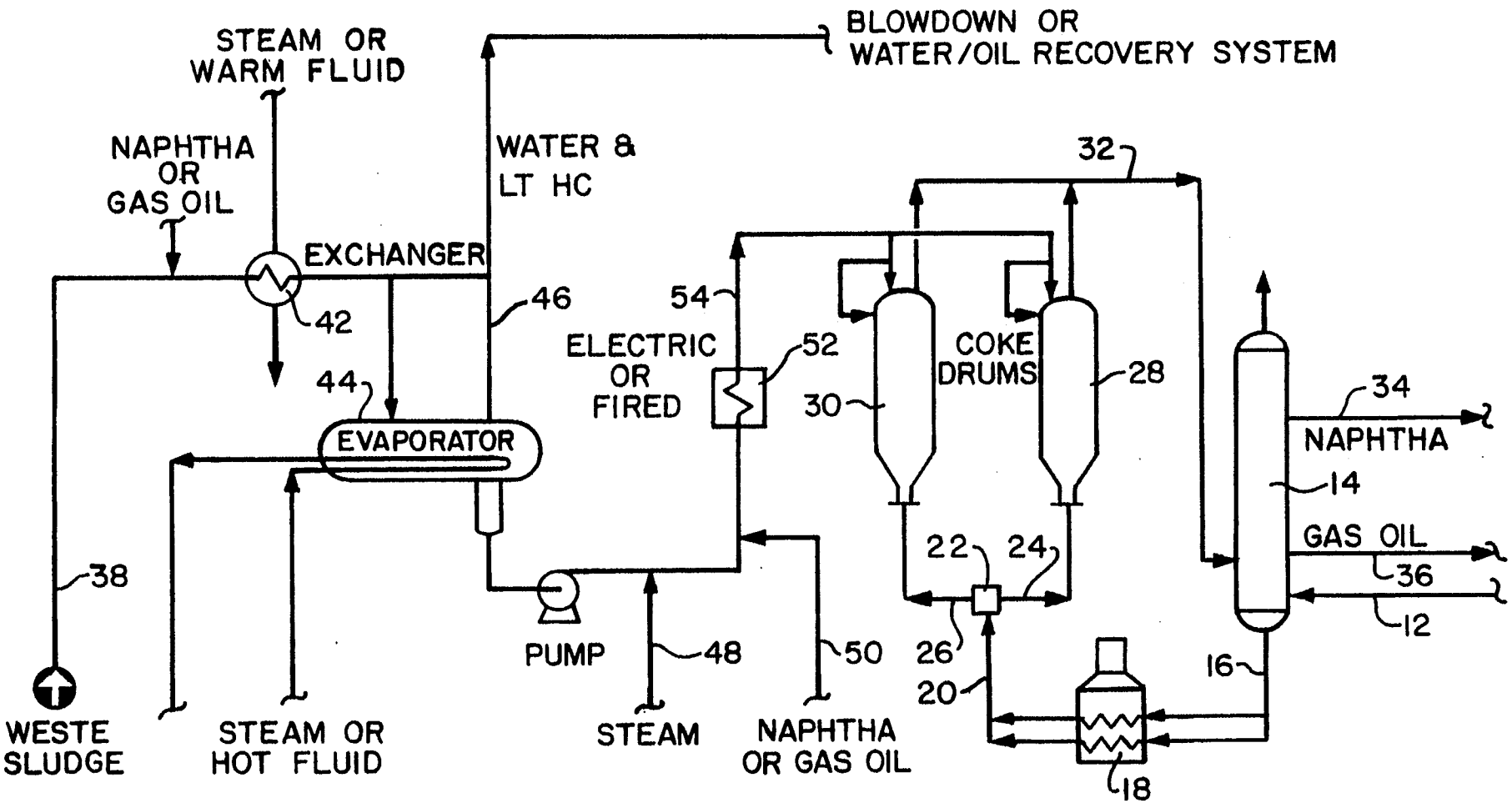
BLOWDOWN OR
WATER/OIL RECOVERY SYSTEM
NAPHTHA
GAS OIL
COKE
DRUMS
ELECTRIC
OR
FIRED
NAPHTHA
OR GAS OIL
STEAM
PUMP
WATER &
LT HC
EXCHANGER
EVAPORATOR
STEAM OR
WARM FLUID
NAPHTHA
OR
GAS OIL
STEAM OR
HOT FLUID
WESTE
SLUDGE
12
14
16
18
20
22
24
26
28
30
32
34
36
38
42
44
46
48
50
52
54

WASTE SLUDGE DISPOSAL PROCESS

BACKGROUND OF THE INVENTION

The present invention relates to the processing of waste refinery sludge material in a delayed coking process.

Waste refinery sludge, having a high water content along with hydrocarbon liquids and solids present a difficult disposal problem. Such waste sludges may come from the API separator (used to separate water and hydrocarbons in refinery waste streams) and from backwashes from strainers in the bottom of the coker fractionator and blowdown tower. One approach has been to dispose of these sludges in the coking process. For example, in U.S. Pat. No. 4,666,585, sludge is fed into the coke drum via the heater transfer line. The sludge is mixed with the coke drum feed and then enters the coke drum. Water and the lighter hydrocarbons in the sludge are vaporized and leave the coke drum as an overhead vapor. The heavier hydrocarbon liquids and solids are mixed in the mesophase in the drum and react to form green coke.

Another variation is shown in U.S. Pat. No. 4,968,407 wherein the sludge is fed into the coker blowdown drum where it is mixed with coker blowdown oil and where water and the lighter hydrocarbons are recovered. The remaining sludge-oil mixture is then fed directly to the bottom of the coke drums via the transfer line either directly or through the fractionator and coker heater.

Sending the waste sludge containing solids to the coke drums through the transfer line and possibly also through the coker heater causes fouling and premature coking because this waste sludge is a more easily cokable material than the normal coker fresh feed.

SUMMARY OF THE INVENTION

An object of the present invention is to dispose of wet waste refinery sludges in a delayed coking process in a manner to avoid fouling and premature coking problems in the components of the delayed coking system. More specifically, an object is to pretreat the sludge separately to vaporize and remove water and light hydrocarbons and then dilute and heat the sludge to a temperature suitable for introduction into the top of the coke drums.

BRIEF DESCRIPTION OF THE DRAWING

The drawing is a schematic flow diagram illustrating a delayed coking process incorporating the present invention.

DESCRIPTION OF THE PREFERRED EMBODIMENT

In the delayed coking process, the fresh coking feed 12 is introduced into the fractionator 14. The selection of this coking feed is well known in the art but the principle feeds are high boiling virgin or cracked petroleum residues such as virgin reduced crude, bottoms from the vacuum distillation of reduced crudes, thermal tar and other heavy residues. The bottoms from the fractionator are fed via line 16 to a coking furnace 18 where the temperature is raised to a level appropriate for forming coke. This heated feedstock is taken from the coking furnace 18 through line 20 to a switch valve 22. This switch valve 22 directs the feedstock through either of the transfer lines 24 or 26 to the respective coke drum 28 or 30. Of course, any desired number of coke drums could be employed. As one coke drum is being filled and the coke is formed, the other drum is being quenched, cooled, drained and de-coked in accordance with conventional delayed coking practices.

The operation of the coke drums is well known in the art. The feed is pumped into the coker heater 18 at about 1035 to 3445 kilopascals where it is preheated to about 455° to 510° C. and then discharged into the bottom of the coke drum through the transfer line. The pressure in the drum is maintained at about 135 to 550 kilopascals. The reaction temperature in the drum is maintained at about 425° to 480° C. The thermally cracked feed produces hydrocarbon vapors and a porous coke mass.

The overhead vapors from the coke drums are sent via line 32 to the fractionator 14. Naphtha and/or gas oil side streams may be extracted from the fractionator at 34 or 36 respectively. These by-products may be used in the processing of the waste sludge as will be explained hereinafter. The process described thus far is a basic delayed coking process.

The waste refinery sludge is fed into the system in line 38 and is first. diluted at 40 with hydrocarbons such as naphtha and/or gas oil which may be from the fractionator 14. The hydrocarbon diluent is used to minimize fouling in heat exchanger equipment and to minimize foaming in the evaporator 44. The dilution ratio of hydrocarbon to sludge varies between 0.2 and 10 depending on the properties of the sludge. The diluted sludge is then heated to 65° to 120° C. at 42 by steam or any available warm fluid from the refinery. The heated, diluted sludge is then sent to the evaporator 44 where the water along with some of the lighter hydrocarbons are vaporized. These vapors 46 are sent to the delayed coker blowdown system or other recovery system (not shown) for water and hydrocarbon recovery. The heating medium for the evaporator may be steam or any suitable and available hot process stream.

The sludge from the evaporator containing mostly heavier hydrocarbon liquids and solids is injected with steam 48 and/or diluent naphtha and/or gas oil 50. The injection of this steam and/or hydrocarbon diluent is used to maintain linear velocity and to minimize coke formation in the heater. The sludge mixture is heated to approximately 340°–440° C. in a fired or electrical heater 52. The heater effluent containing vapor, liquid and solids is sent to the coke drum through line 54 and a nozzle located in the top head or on the upper side of the coke drum. The vapor from the sludge is mixed with the coke drum overhead vapor and is sent to the coker fractionator through line 32. The unvaporized liquids and solids drop into and mix with the mesophase inside the drum. Along with the normal coke drum feed, this unvaporized, preconditioned sludge undergoes the conventional thermal cracking and polymerization reactions to form green coke.

Since the sludge is fed to the top of the coke drum, the problem of fouling and premature coking in the transfer lines 24 and 26 or possibly in the coking furnace 18 is avoided since they are not exposed to the waste sludge at elevated temperatures. The equipment that is associated with processing the sludge can be periodically shutdown for decoking and cleaning without affecting the on-going operation of the delayed coking system. The waste sludge system is sized so that it may be operated during only part of the coking drum filling cycle. Another benefit that is desired is that the vapor from the waste sludge heater reduces the overhead temperature of the coke drum vapor acting as quench. By reducing this temperature, any coking which might take place in the coke drum overhead piping 32 is reduced.

We claim:

1. A method for disposing of waste refinery sludge in a delayed coking process employing at least one coke drum comprising the steps of:

a. feeding a heated fresh coking feed into a coke drum through the bottom of said drum while maintaining coking conditions in said drum;

b. providing a waste refinery sludge containing water, light hydrocarbons and heavy hydrocarbons;

c. diluting said waste stream with a hydrocarbon selected from the group consisting of naphtha and gas oil to minimize fouling and foaming;

d. heating said stream and evaporating water and light hydrocarbons therefrom;

e. further heating said stream to a coking temperature and introducing said stream into said coke drum through the top portion thereof whereby vapor from said sludge is discharged from said coke drum with overhead vapor from said coking feed and unvaporized liquids and solids from said sludge are mixed with the material being coked.

* * * * *